US009701141B2

(12) United States Patent
Matsuhashi

(10) Patent No.: US 9,701,141 B2
(45) Date of Patent: Jul. 11, 2017

(54) RECORDING APPARATUS

(71) Applicant: SEIKO EPSON CORPORATION, Tokyo (JP)

(72) Inventor: Kunihiko Matsuhashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/541,533

(22) Filed: Nov. 14, 2014

(65) Prior Publication Data

US 2015/0138293 A1 May 21, 2015

(30) Foreign Application Priority Data

Nov. 20, 2013 (JP) ..... 2013-239662

(51) Int. Cl.

| | |
|---|---|
| ***B41J 13/10*** | (2006.01) |
| ***B41F 17/00*** | (2006.01) |
| ***B41J 3/407*** | (2006.01) |
| ***B41J 11/00*** | (2006.01) |
| ***B41J 11/06*** | (2006.01) |

(52) U.S. Cl.

CPC ..... *B41J 13/10* (2013.01); *B41F 17/005* (2013.01); *B41J 3/4078* (2013.01); *B41J 11/007* (2013.01); *B41J 11/06* (2013.01)

(58) Field of Classification Search

CPC ..... B41J 13/10

See application file for complete search history.

(56) References Cited

U.S. PATENT DOCUMENTS

| | | | | |
|---|---|---|---|---|
| 6,066,206 | A * | 5/2000 | Doyle | H05K 3/1216 101/123 |
| 2002/0060728 | A1 | 5/2002 | Koizumi et al. | |
| 2007/0068403 | A1 | 3/2007 | Fresener et al. | |
| 2009/0058972 | A1 | 3/2009 | Ando et al. | |

FOREIGN PATENT DOCUMENTS

| | | |
|---|---|---|
| EP | 2033782 | 3/2009 |
| JP | 05-138856 | 6/1993 |
| JP | 05138856 | 6/1993 |
| JP | 2009-056657 | 3/2009 |
| WO | 03/093014 | 11/2003 |

OTHER PUBLICATIONS

European Search Report for Application No. 14193171.7 dated Mar. 10, 2015.

* cited by examiner

*Primary Examiner* — Manish S Shah
*Assistant Examiner* — Jeffrey C Morgan
(74) *Attorney, Agent, or Firm* — Workman Nydegger

(57) ABSTRACT

Provided are recording sections which record onto recording media which are supported on pallets, a first transport section which transports the recording media by moving the pallets in a first region which does not include recording positions according to the recording sections, and second transport section which transports the recording media with higher precision than the first transport section in a second region which includes the recording positions.

8 Claims, 8 Drawing Sheets

RECORDING APPARATUS

BACKGROUND

1. Technical Field

The present invention relates to a recording apparatus.

2. Related Art

In the related art, recording apparatuses provided with pallets which support recording media are used. Of these, for example, JP-A-5-138856 discloses a recording apparatus which carries out recording onto a recording medium while moving a moving printing platform, which corresponds to a pallet, around.

In this manner, users desire not only to carry out recording with high recording quality in recording apparatuses provided with pallets which support recording media, but also to improve the transport efficiency of the recording media.

Here, JP-A-5-138856 described above does not specifically disclose how to move and control the moving printing platform at the recording positions. That is, the recording apparatus which is disclosed in JP-A-5-138856 does not have a configuration where recording is carried out with high recording quality or where the transport efficiency of the recording media is improved.

SUMMARY

An advantage of some aspects of the invention is to carry out recording with high recording quality in a recording apparatus provided with pallets which support recording media and to improve transport efficiency of the recording media.

According to an aspect of the invention, there is provided a recording apparatus including a recording section which carries out recording onto a recording medium which is supported on a pallet, a first transport section which transports the recording medium by moving the pallet in a first region which does not include a recording position according to the recording section, and a second transport section which transports the recording medium with higher precision than the first transport section in a second region which includes the recording position.

According to the aspect, the second transport section transports the recording media with higher precision than the first transport section in the second region which includes the recording position. For this reason, it is possible to carry out recording with high recording quality.

In addition, according to the aspect, in the first region which does not include the recording position, the recording media are transported with a transport precision which is different from the first transport section which is different from the second transport section. For this reason, since the transport precision may be lower in the first region, it is possible to increase the moving speed of the pallets and it is possible to improve the transport efficiency of the recording media.

That is, according to the aspect, it is possible to carry out recording with high recording quality and to improve transport efficiency of the recording media.

Here, the "second transport section which transports the recording media with higher precision than the first transport section" has the meaning of both a case where the first transport section and the second transport section are transport sections with the same configuration and the second transport section transports the recording media with higher precision and a case where the first transport section and the second transport section are transport sections with different configurations and the second transport section transports the recording media with higher precision.

In this aspect of the recording apparatus of the invention, a plurality of transport paths which transport the recording media are provided in the second region.

According to the aspect, a plurality of transport paths which transport the recording media may be provided in the second region. For this reason, it is possible to increase the moving speed of the pallets in the first region and to transport the recording media with high precision in the plurality of transport paths in the second region. That is, it is possible to achieve both recording with high recording quality and improving transport efficiency of the recording media at a high level.

In this aspect of the recording apparatus of the invention, the recording section may be common to the plurality of the transport paths.

According to the aspect, the recording section is common to the plurality of the transport paths. For this reason, it is possible to improve the use efficiency of the recording section. In addition, by arranging the plurality of transport paths and performing the recording in parallel with the recording media which are supported on a plurality of pallets, it is possible to increase the speed of recording per unit of time.

In this aspect of the recording apparatus of the invention, the second transport section may transport the recording media by moving the pallets.

According to the aspect, the second transport section transports the recording media by moving the pallets. That is, it is possible for the pallets to have a simple configuration. In addition, since it is possible to support and transport the recording media on the pallets, it is possible to carry out transporting in a stable manner even in a case where the types or materials of the recording media are different or variations occur in the shapes thereof.

In this aspect of the recording apparatus of the invention, the second transport section may be provided on the pallet and transport the recording media by moving the recording media on the pallet.

According to the aspect, the second transport section is provided on the pallets and transports the recording media by moving the recording media on the pallets. That is, it is possible for the mechanism to have a simple configuration when moving the pallets themselves and it is possible to improve the transport precision of the recording media by providing a mechanism with high feeding precision on the pallets.

In this aspect of the recording apparatus of the invention, the recording section may be a recording head which discharges ink onto the recording media.

According to the aspect, it is possible to perform recording without contact by discharging the ink, and it is possible to perform recording with respect to various types of recording media.

This aspect of the recording apparatus of the invention may further include a drying section which dries the ink, in which the drying section is provided in the first region.

According to the aspect, the drying speed of the ink is increased by the drying section and it is possible to carry out recording with high efficiency.

This aspect of the recording apparatus of the invention may further include a pallet moving section which moves the pallets from the second region to the first region.

According to the aspect, a pallet moving section which moves the pallets from the second region to the first region is provided. For this reason, it is possible to separate the second region and the first region. That is, the influence of the regions on each other is reduced and it is possible to provide various processing sections in each of the regions. For example, by providing the recording head and the drying section separately, the risk of discharge defects caused by the ink in the recording head drying due to the influence of the drying section is reduced.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiment 1

FIG. 1 to FIG. 6

Detailed description will be given below of the recording apparatus according to Embodiment 1 of the invention with reference to the accompanying drawings.

Here, a recording apparatus 1 of the embodiment is an ink jet type recording apparatus which performs recording by discharging ink from a recording head as a recording section; however, the recording apparatus 1 is not limited to an ink jet type recording apparatus.

FIG. 1 to FIG. 6 are schematic planar diagrams representing the recording apparatus 1 of the embodiment.

Figure 1:
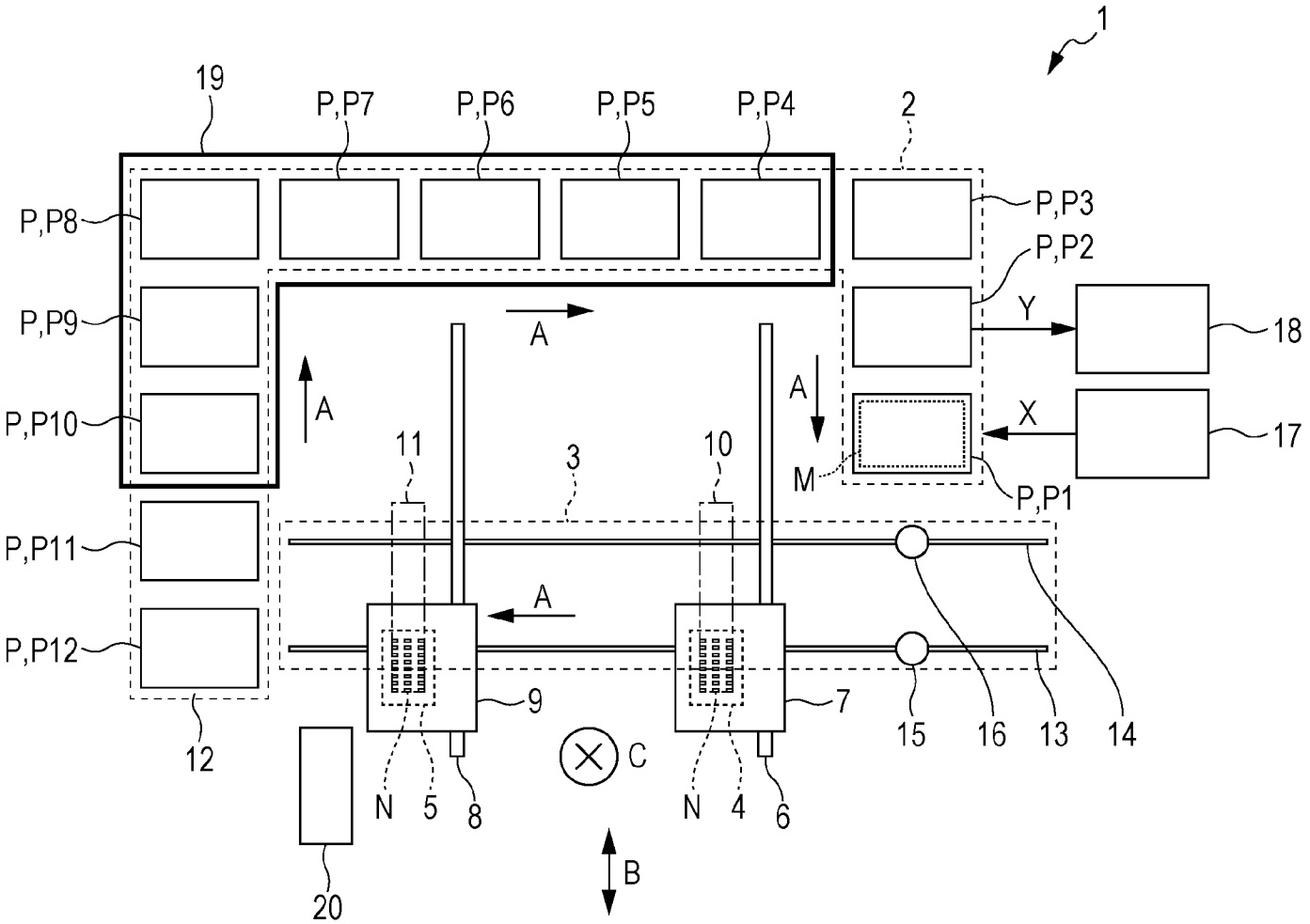
FIG. 1 is a schematic planar diagram which represents a recording apparatus according to Embodiment 1 of the invention.

FIG. 1 represents a state before recording media M are set on pallets P.

The recording apparatus 1 of the embodiment is provided with a recording head 4 as the recording section which discharges white ink as a base layer W from nozzles N in a direction C onto the recording media M which are supported on the pallets P. In addition, a recording head 5 is provided as a recording section which discharges color inks for forming a recorded image I from nozzles N in the direction C onto the recording media M where white ink is discharged as the base layer W. Here, the recording apparatus 1 of the embodiment is provided with a total of twelve pallets P from a pallet P1 to a pallet P12.

The recording head 4 discharges white ink onto the recording media M by being mounted on a carriage 7 and moving forward and backward in a direction B along a guide bar 6. In addition, the recording head 5 discharges color inks onto the recording media M by being mounted on a carriage 9 and moving forward and backward in a direction B along a guide bar 8.

Here, a position which opposes the nozzles N of the recording head 4 during the forward and backward movement of the recording head 4 in the direction B is a recording position 10 and a position which opposes the nozzles N of the recording head 5 during the forward and backward movement of the recording head 5 in the direction B is a recording position 11.

Here, the recording apparatus 1 of the embodiment is provided with the recording heads 4 and 5 which carry out recording while moving forward and backward; however, the recording apparatus 1 may be a recording apparatus which is provided with a so-called line head where a plurality of nozzles which discharge ink are provided in the direction B which intersects with a transport direction A.

Here, the "line head" is a recording head which is used in a recording apparatus where a region of nozzles which are formed in the direction B which intersects with the transport direction A of the recording medium M is provided so as to be able to cover the entirety of the recording media M in the direction B, and which forms images by fixing one of the recording head or the recording media M and moving the other. Here, the region of the nozzles in the line head in the direction B does not need to be able to cover the entirety of the recording media M in the direction B which correspond to the recording apparatus. In addition, both of the recording head and the recording media M are configured so as to be able to move, and images may be formed by moving one or both of the recording head and the recording media M.

In addition, the recording apparatus 1 of the embodiment has a first region 2 which does not include the recording position 10 according to the recording head 4 and the recording position 11 according to the recording head 5, and a second region 3 which includes the recording position 10 according to the recording head 4 and the recording position 11 according to the recording head 5 as transport paths for the recording media M.

In the first region 2, a roller 12 is provided across the entirety of the first region 2 as the first transport section which transports the recording media M by moving the pallets P. Here, since the first region 2 does not include the recording position 10 according to the recording head 4 and the recording position 11 according to the recording head 5, it is possible for the first transport section to have a simple configuration where high speed transporting is possible and the transport precision is not so high, such as the roller 12 of the embodiment.

In addition, the second region 3 is provided with a plurality (two) of the transport paths which transport the pallets P which support the recording media M: a first transport path 13 and a second transport path 14. Then, a carriage 15 is provided in the first transport path 13 as the second transport section which transports the recording media M with higher precision than the roller 12, and a carriage 16 is provided in the second transport path 14 as the second transport section which transports the recording media M with higher precision than the roller 12.

The recording media M which are supported on the pallet P are transported in the transport direction A using the roller 12 and the carriage 15 or the carriage 16.

A supply section 17 which supplies the recording media M on the pallets P by moving the recording media M in a direction X and a recovery section 18 which recovers the recording media M from the pallets P by moving the recording media M in a direction Y are provided in the first region 2. That is, the recording media M are moved from the supply section 17 in the direction X so as to be supported on the pallets P, transported in the transport direction A in a state of being supported on the pallets P, and moved from the pallets P in the direction Y so as to be recovered in the recovery section 18.

In addition, a drying section 19 which dries the white ink which is discharged from the recording head 4 onto the recording media M and the color inks which are discharged from the recording head 5 onto the recording media M is provided in the first region 2.

In addition, a pallet moving section 20 which moves the pallets P from the second region 3 to the first region 2 is provided in the vicinity of the rear end of the second region 3 in the transport direction A. Here, the recording apparatus 1 of the embodiment is also provided with a pallet moving section (which are not shown in the diagram) which moves the pallets P from the first region 2 to the carriages 15 and 16 of the second region 3.

Below, detailed description will be given of the operation of the recording apparatus 1 of the embodiment after the recording media M are set on the pallets P with reference to FIG. 2 to FIG. 6.

Figure 2:
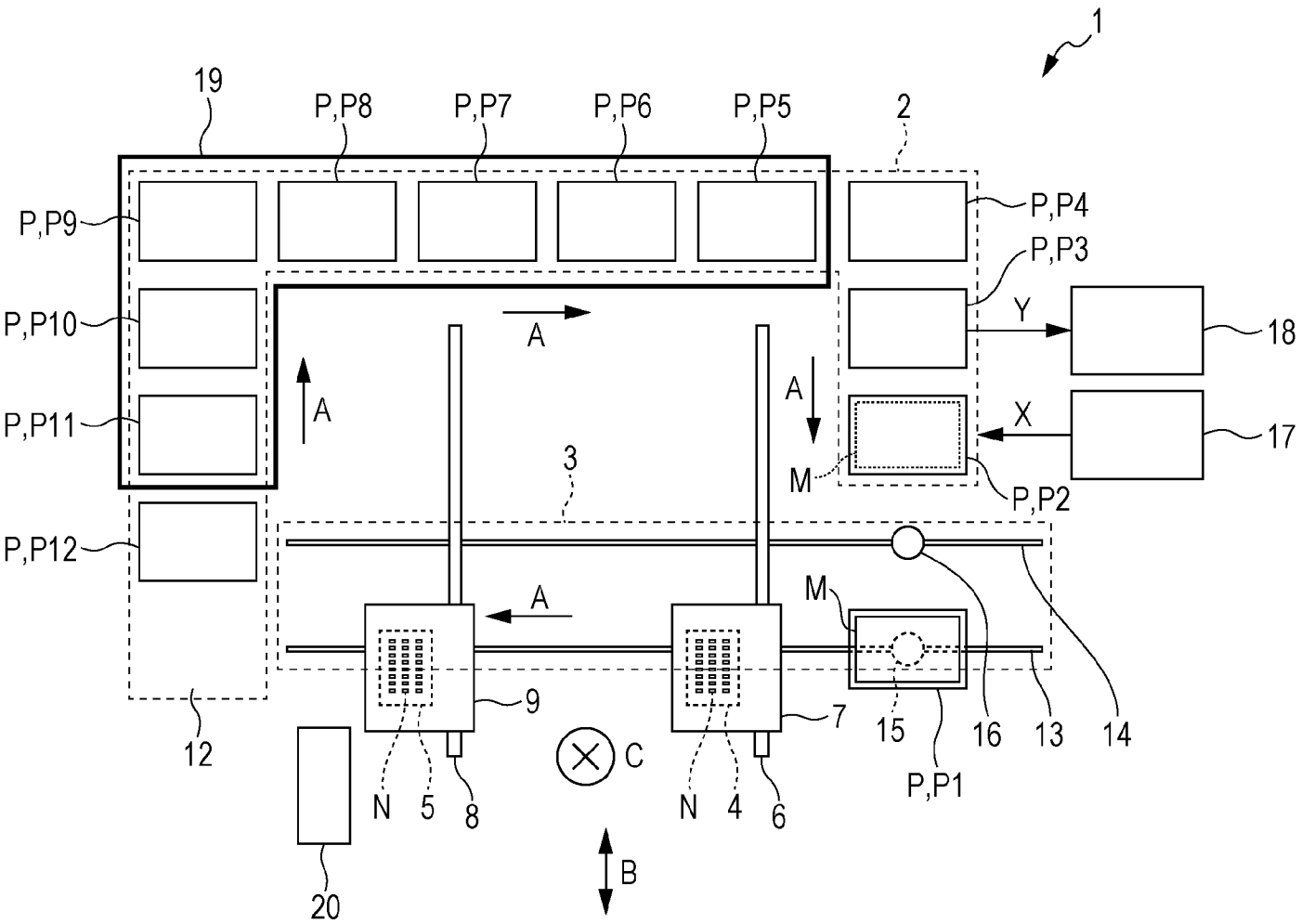
FIG. 2 is a schematic planar diagram which represents the recording apparatus according to Embodiment 1 of the invention.

FIG. 2 represents a state where the recording medium M is set on the pallet P1 in the first region 2 and the pallet P1 where the recording medium M is set is moved on the carriage 15 in the first transport path 13 in the second region 3.

Here, in accordance with the pallet P1 moving on the carriage 15 from the setting position of the recording medium M, the pallet P2 to the pallet P12 in the first region 2 move in the transport direction A from the state which is represented in FIG. 1.

Figure 3:
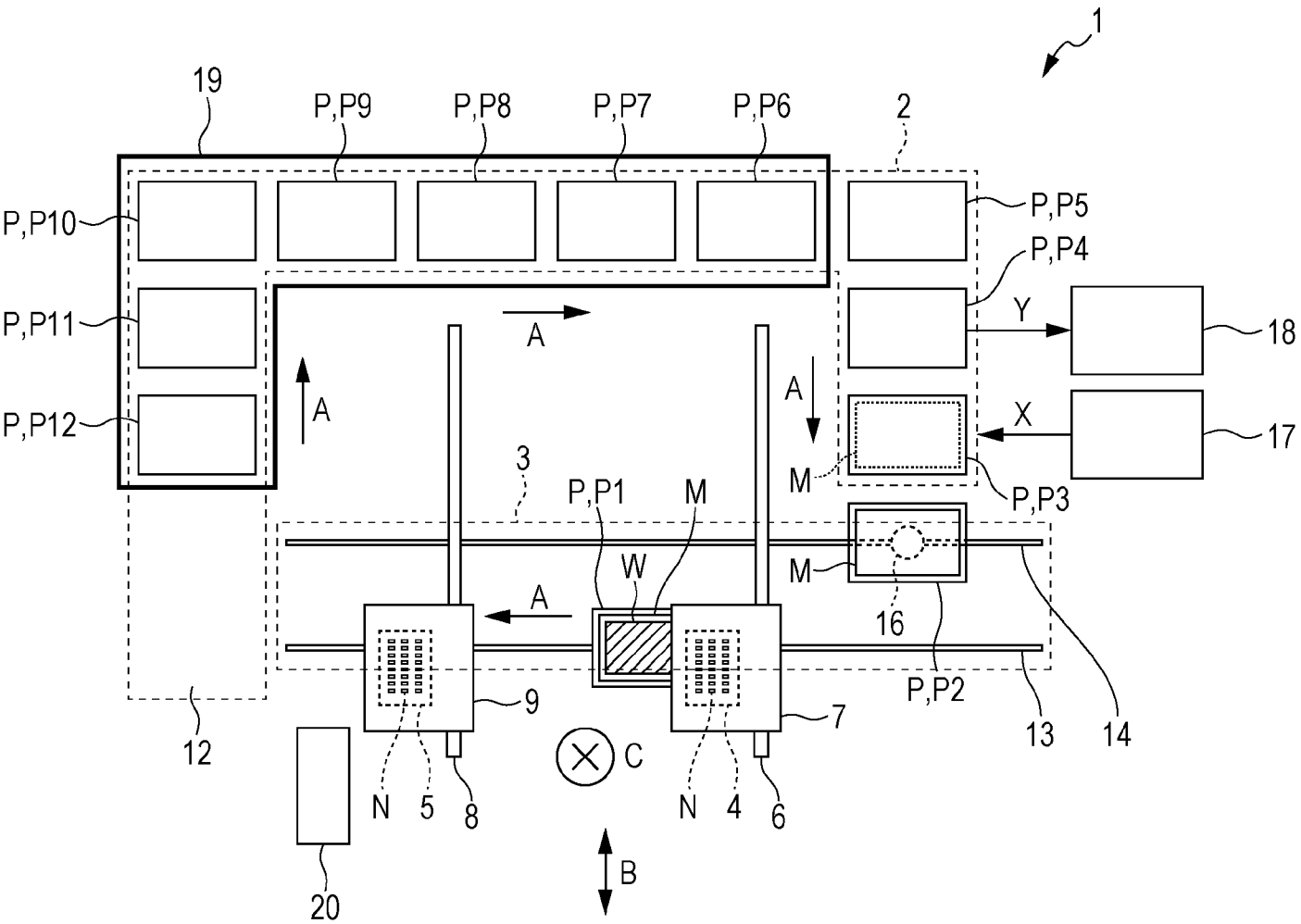
FIG. 3 is a schematic planar diagram which represents the recording apparatus according to Embodiment 1 of the invention.

FIG. 3 represents a state where the pallet P1 where the recording medium M is set is on the carriage 15 in the first transport path 13 in the second region 3 and the pallet P2 where the recording medium M is set is on the carriage 16 in the second transport path 14 in the second region 3.

Here, in accordance with the pallet P2 moving on the carriage 15 from the setting position of the recording medium M, the pallet P3 to the pallet P12 in the first region 2 move further in the transport direction A from the state which is represented in FIG. 2.

In addition, in FIG. 3, the base layer W is formed on the recording medium M which is supported on the pallet P1 by discharging white ink from the recording head 4.

Figure 4:
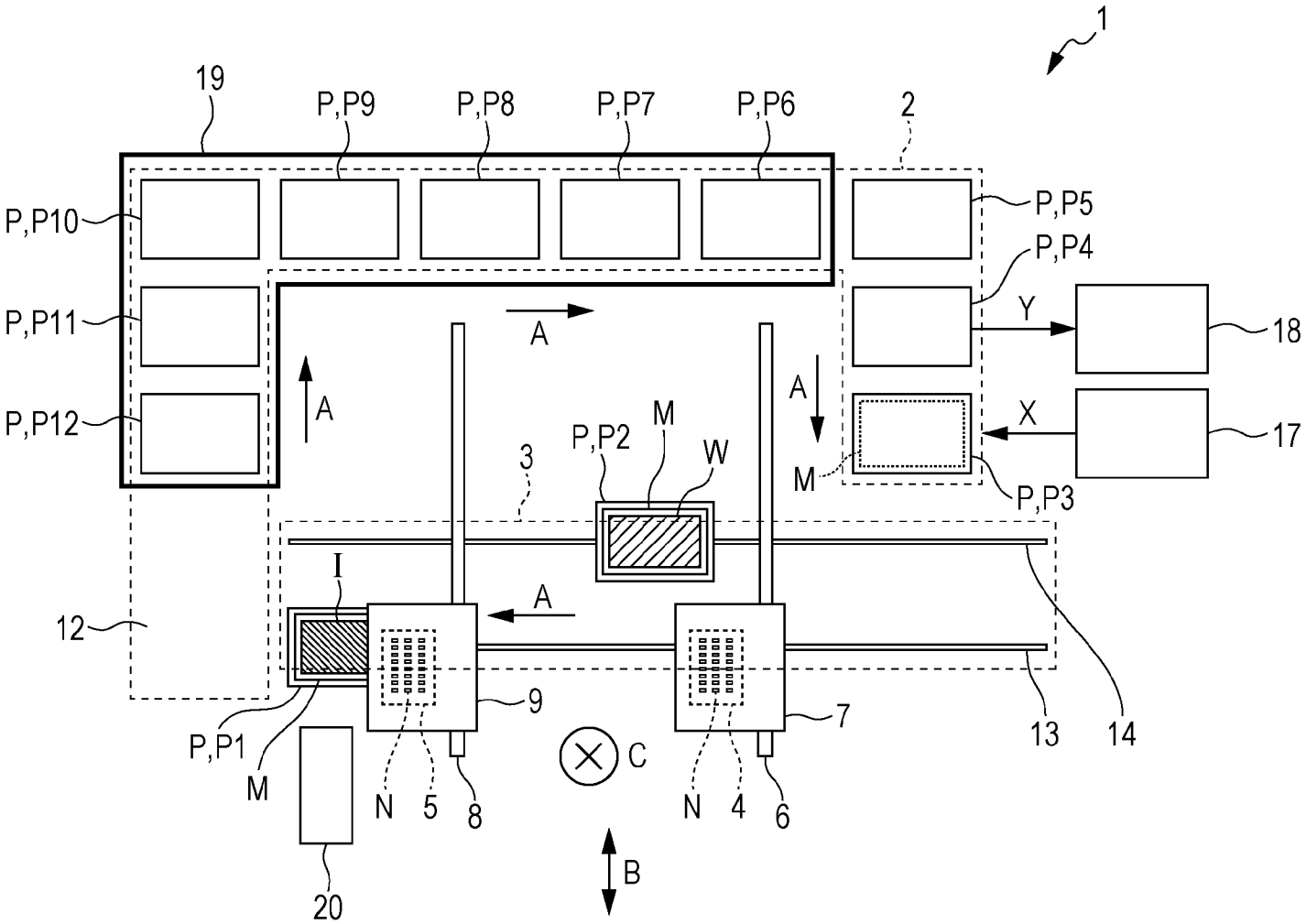
FIG. 4 is a schematic planar diagram which represents the recording apparatus according to Embodiment 1 of the invention.

In a similar manner to FIG. 3, FIG. 4 represents a state where the pallet P1 where the recording medium M is set is on the carriage 15 in the first transport path 13 in the second region 3 and the pallet P2 where the recording medium M is set is on the carriage 16 in the second transport path 14 in the second region 3.

However, in FIG. 4, the recorded image I is formed on the recording medium M which is supported on the pallet P1 by discharging color ink from the recording head 5 and the base layer W is formed on the recording medium M which is supported on the pallet P2 by discharging white ink from the recording head 4.

Figure 5:
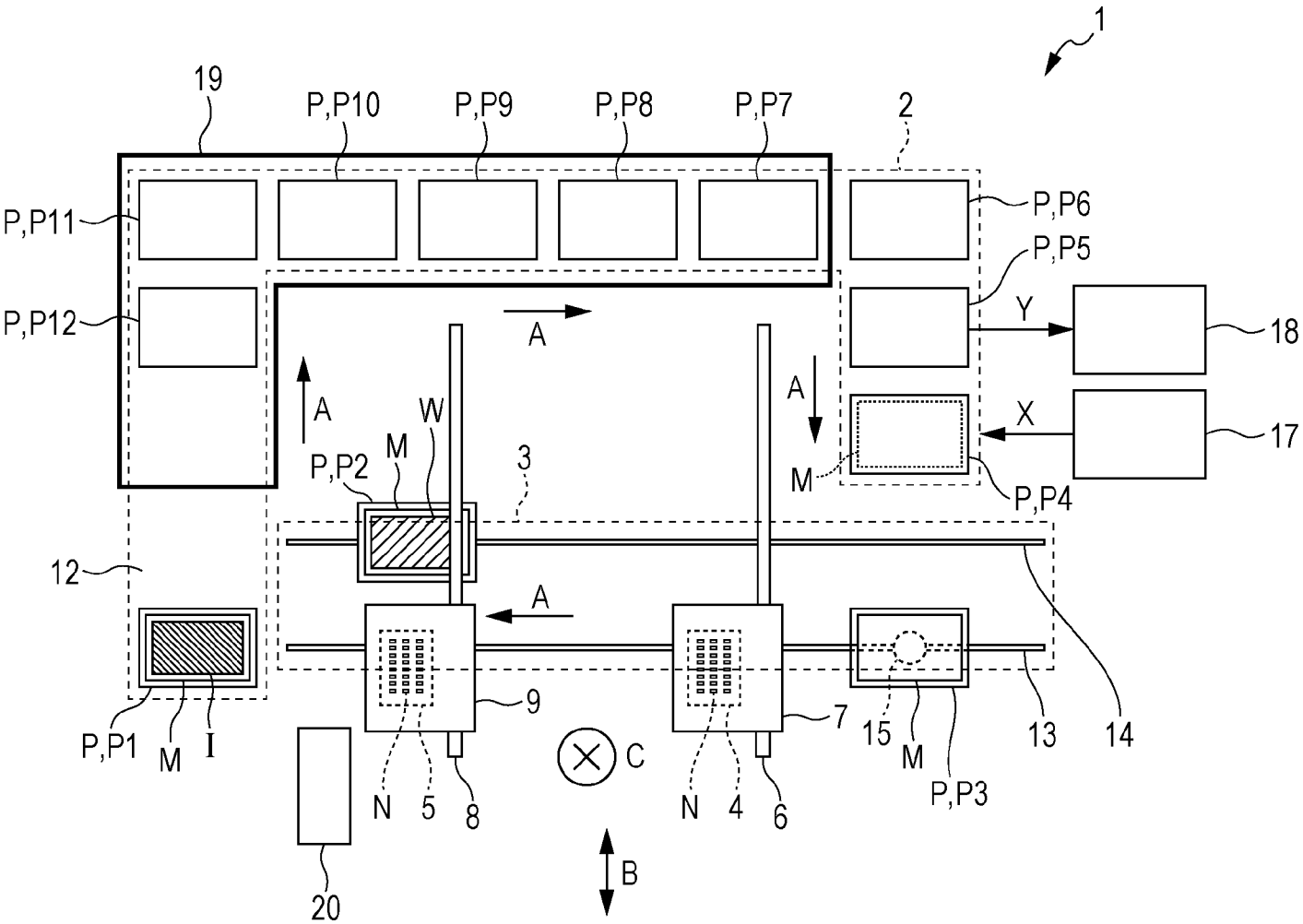
FIG. 5 is a schematic planar diagram which represents the recording apparatus according to Embodiment 1 of the invention.

FIG. 5 represents a state where the pallet P1 moves from the first transport path 13 of the second region 3 to the first region 2 and the pallet P3 where the recording medium M is set is on the carriage 15 of the first transport path 13 in the second region 3.

In addition, FIG. 5 shows a state in the middle of forming the recorded image I on the recording medium M which is supported on the pallet P2 by color ink being discharged from the recording head 5.

Here, in accordance with the pallet P3 moving on the carriage 15 from the setting position of the recording medium M, the pallet P4 to the pallet P12 in the first region 2 move further in the transport direction A from the state which is represented in FIG. 3 and FIG. 4.

Figure 6:
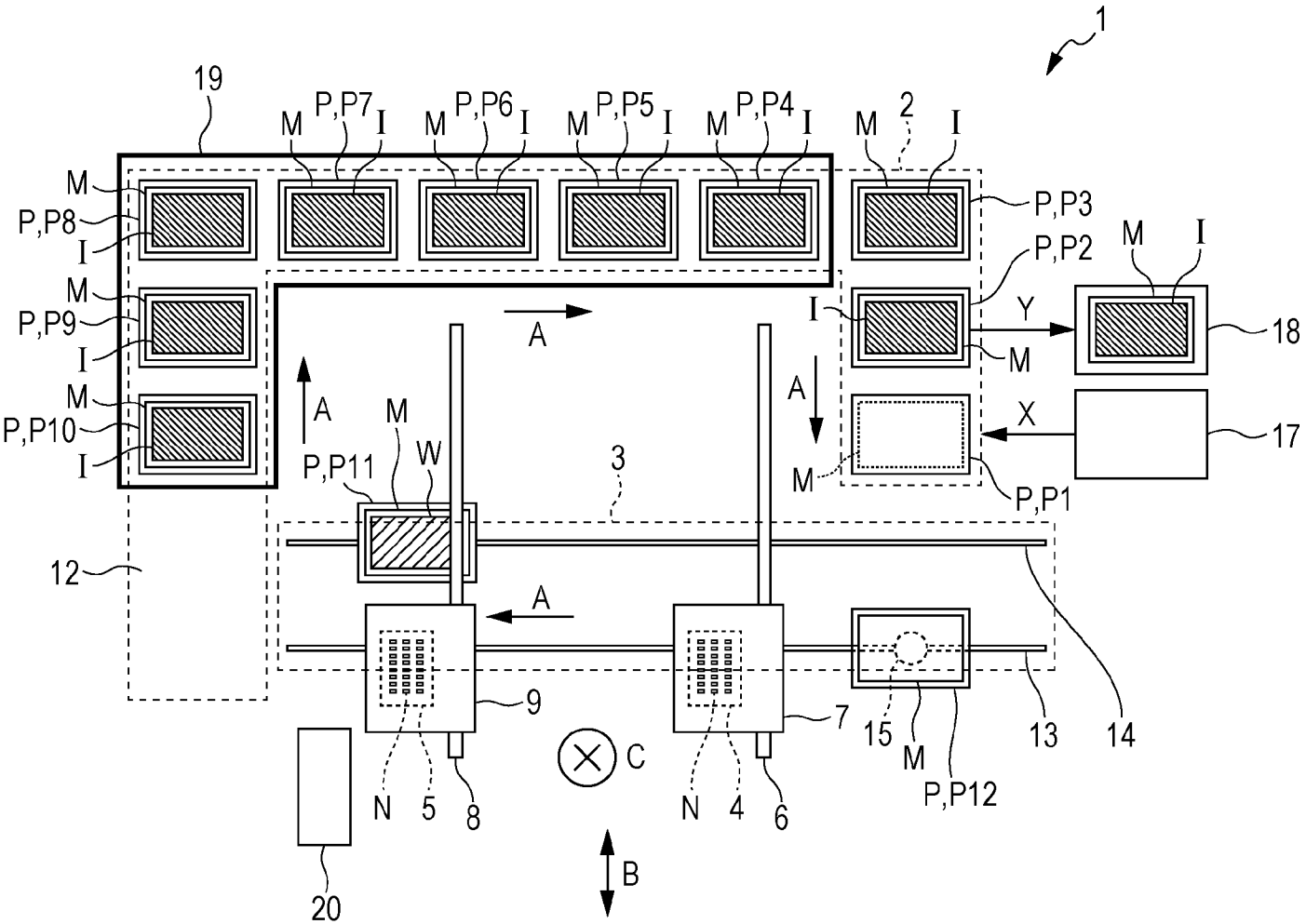
FIG. 6 is a schematic planar diagram which represents the recording apparatus according to Embodiment 1 of the invention.

FIG. 6 represents a state where recording onto the recording media M which are supported on the pallets P proceeds, and the pallet P1 again reaches the setting position of the recording medium M.

In FIG. 6, the pallet P12 where the recording medium M is set is positioned on the carriage 15 in the first transport path 13 and the recorded image I is in the middle of being formed on the recording medium M which is supported on the pallet P11 by color ink being discharged from the recording head 5. In addition, on the recording media M which are supported on the pallet P4 to the pallet P10, the white ink discharged from the recording head 4 and the color inks discharged from the recording head 5 are in the middle of being dried by the drying section 19 which is provided in a first region 2. In addition, the pallet P2 and the pallet P3 pass through the region where drying is carried out by the drying section 19 and the pallet P2 is set such that the recording medium M is recovered in the direction Y by the recovery section 18. Then, the pallet P1 is set such that the recording medium M is supplied in the direction X by the supply section 17.

As described above, the recording apparatus 1 of the embodiment is provided with the recording heads 4 and 5 which carry out recording onto the recording media M which are supported on the pallets P, the roller 12 as a first transport section which transports the recording media M by moving the pallets P in the first region 2 which does not include the recording positions 10 and 11 according to the recording heads 4 and 5, and carriages 15 and 16 as the second transport section which transports the recording media M with higher precision than the roller 12 in the second region 3 which includes the recording positions 10 and 11.

In this manner, in the recording apparatus 1 of the embodiment, the carriages 15 and 16 transport the recording media M with higher precision than the roller 12 in the second region 3 which includes the recording positions 10 and 11. For this reason, it is possible to carry out recording with high recording quality.

In addition, the recording apparatus 1 of the embodiment transports the recording media M with a different transport precision in the first region 2 which does not include the recording positions 10 and 11 using the roller 12 which is different from the carriages 15 and 16. Then, since the transport precision in the first region 2 may be lower, the moving speed of the pallets P according to the roller 12 increases and the transport efficiency of the recording media M is improved.

That is, the recording apparatus 1 of the embodiment carries out recording with high recording quality and improves the transport efficiency of the recording media M.

Here, the recording apparatus 1 of the embodiment is a transport section with a configuration where the roller 12 as the first transport section and the carriages 15 and 16 as the second transport section are different. However, for example, as in a case where the first transport section and the second transport section are both carriages, there may be a configuration where the first transport section and the second transport section are transport sections with the same configuration and the second transport section transports the recording media with higher precision.

In addition, in the second region 3 of the recording apparatus 1 of the embodiment, a plurality of transport paths which transport the recording media M are provided: the first transport path 13 and the second transport path 14.

Then, as described above, the moving speed of the pallets P in the first region 2 increases and the recording media M are transported with a high precision in the first transport path 13 and the second transport path 14 in the second region 3. That is, both recording with high recording quality and improving the transport efficiency of the recording media M are achieved at a high level.

In addition, the recording heads 4 and 5 of the recording apparatus 1 of the embodiment are common to the first transport path 13 and the second transport path 14.

According to this configuration, the use efficiency of the recording heads 4 and 5 increases in the recording apparatus 1 of the embodiment. In addition, by arranging the first transport path 13 and the second transport path 14 and performing recording in parallel with the recording media M which are supported on the plurality of pallets P, it is possible to increase the speed of recording per unit of time.

In addition, the carriages 15 and 16 which are the second transport section of the recording apparatus 1 of the embodiment have a configuration where the recording media M are transported by moving the pallets P.

For this reason, it is possible for the pallets P to have a simple configuration. In addition, since it is possible to support and transport the recording media M on the pallets P, it is possible to carry out transporting in a stable manner even in a case where the types or materials of the recording media M are different or variations occur in the shapes thereof.

In addition, the recording heads 4 and 5 of the recording apparatus 1 of the embodiment are recording heads which discharge ink onto the recording medium M. For this reason, it is possible to perform recording without contact by discharging the ink, and it is possible to perform recording with respect to various types of recording media M.

Then, the recording apparatus 1 is provided with the drying section 19 which is provided in the first region 2 and which dries the ink, and the pallet moving section 20 which moves the pallets P from the second region 3 to the first region 2.

For this reason, it is possible to separate the second region 3 and the first region 2, the influence of the regions on each other is reduced, and it is possible to provide various processing sections in each of the regions. In the embodiment, the recording heads 4 and 5 and the drying section 19 are provided separately. When the recording heads 4 and 5 and the drying section 19 are not provided separately, there is a risk of discharge defects caused by the ink in the recording heads 4 and 5 drying due to the influence of the drying section 19. However, since the recording apparatus 1 of the embodiment is provided with the pallet moving section 20 which moves the pallets P from the second region 3 to the first region 2, the second region 3 where the recording heads 4 and 5 are provided and the first region 2 where the drying section 19 is provided are separated. In this manner, the risk of discharge defects occurring is reduced.

Embodiment 2

FIG. 7 to FIG. 8

Below, detailed description will be given of a recording apparatus of Embodiment 2 with reference to the accompanying drawings.

Figure 7:
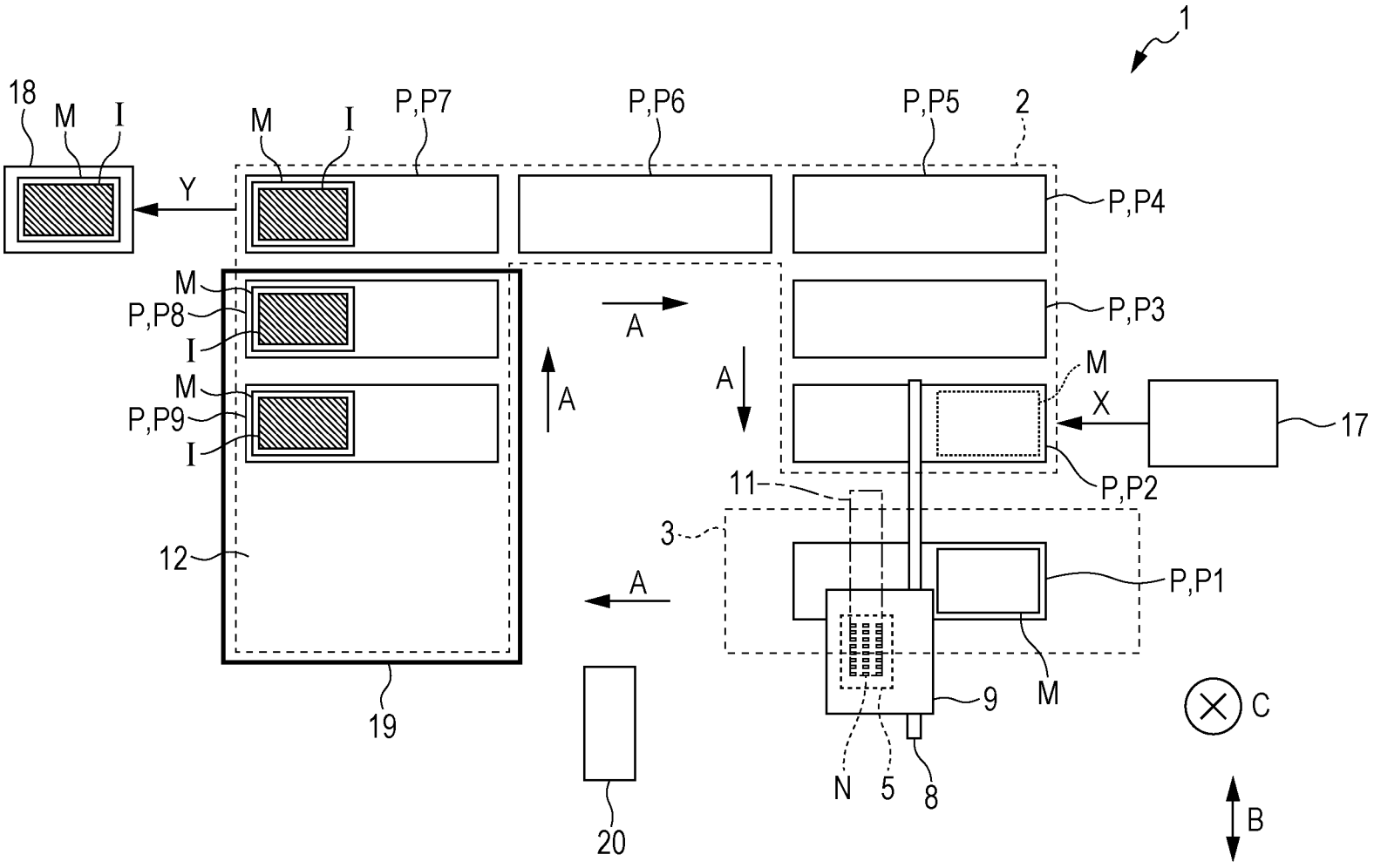
FIG. 7 is a schematic planar diagram which represents a recording apparatus according to Embodiment 2 of the invention.
Figure 8:
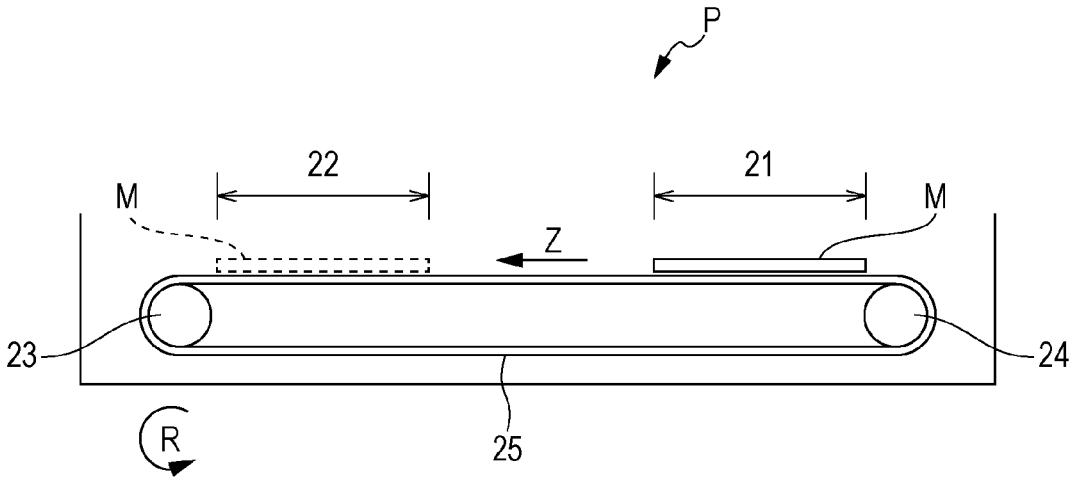
FIG. 8 is a schematic side cross-sectional diagram which represents a pallet of the recording apparatus according to Embodiment 2 of the invention.

FIG. 7 is a schematic planar diagram which represents the recording apparatus 1 of the embodiment. In addition, FIG. 8 represents a schematic side cross-sectional diagram which represents the pallet P of the recording apparatus 1 of the embodiment. Here, the constituent members which are common to Embodiment 1 described above are illustrated with the same reference numerals and detailed description thereof will be omitted.

As represented in FIG. 7, the recording apparatus 1 of the embodiment does not have a configuration where the second transport section, which transports the recording medium M in the second region 3 which includes the recording positions 10 and 11, transports the recording media M by moving the pallets P, but a configuration where the second transport section is provided on the pallet P and moves the recording media M on the pallet P. Then, the sizes, positions, and the like of each of the constituent members of the recording apparatus 1 of the embodiment and each of the constituent members of the recording apparatus 1 of Embodiment 1 are different. However, apart from these differences in configuration, the recording apparatus 1 of the embodiment has the same characteristics as the recording apparatus 1 of Embodiment 1.

As represented in FIG. 8, the pallet P in the recording apparatus 1 of the embodiment is provided with a transport belt 25 which is extended between a driving roller 23 and a driven roller 24 which are able to rotate and drive in a rotation direction R, as a second transport section. Then, by rotating the driving roller 23 in the rotation direction R, the recording media M which are set in a setting position 21 for the recording media M on the transport belt 25 are transported in a Z direction which corresponds to the transport direction A and it is possible to carry out transporting up to a recovery position 22 for the recording media M.

To express the above in another manner, the transport belt 25 which is the second transport section of the recording apparatus 1 of the embodiment is configured to be provided on the pallet P and to be able to transport the recording media M by moving the recording media M on the pallet P.

Due to this configuration, it is not necessary for the recording apparatus 1 of the embodiment to be provided with a mechanism for moving the pallets P in the second region 3, and the mechanism which moves the pallets P themselves throughout the recording apparatus 1 has a simple configuration.

Here, the mechanism which moves the recording medium M on the pallet P is not limited to the above description. The mechanism may be a mechanism using a member such as a gear or a shaft, a mechanism which combines the above, or the mechanism may have a configuration which uses a linear motor. In addition, the mechanism may be configured to be able to move not only in one direction such as the Z direction, but also in a direction which intersects with the Z direction. Furthermore, a configuration which is able to move not only in one direction, but also in both directions in a predetermined direction is preferable.

In either case, a configuration where it is possible to recognize the positional relationship of a member, which supports the recording medium M, or of the recording medium M with respect to the pallet P is preferred, but there may be a configuration where it is possible to recognize the positional relationship of the recording medium M with respect to the recording apparatus 1. In addition, in order to recognize the positional relationship of the recording medium M, it is possible to use various types of sensors, or image recognition may be carried out by capturing the state of the recording medium M using a camera.

The entire disclosure of Japanese Patent Application No. 2013-239662, filed Nov. 20, 2013 is expressly incorporated by reference herein.

What is claimed is:

1. A recording apparatus comprising:

a recording section which carries out recording onto a recording medium which is supported on a pallet;

a first transport section which transports the recording medium by moving the pallet in a first region which does not include a recording position according to the recording section; and a second transport section which transports the recording medium with higher precision than the first transport section in a second region which includes the recording position, the second transport section transports the recording medium slower than the first transport section, wherein a plurality of transport paths which transport pallets individually with the recording media are provided in the second region, and wherein the recording section moves in a direction which intersects with the plurality of transport paths, wherein the plurality of transport paths terminate at the first transport section having a single transport path to transport the pallets received from the plurality of transport paths.

2. The recording apparatus according to claim 1, wherein the recording section is common to the plurality of the transport paths.

3. The recording apparatus according to claim 1, wherein the second transport section transports the recording media by moving the pallets.

4. The recording apparatus according to claim 1, wherein the recording section is a recording head which discharges ink onto the recording media.

5. The recording apparatus according to claim 4, further comprising:

a drying section which dries the ink, wherein the drying section is provided in the first region.

6. The recording apparatus according to claim 1, further comprising:

a pallet moving section which moves the pallets from the second region to the first region.

7. The recording apparatus according to claim 1, wherein the second transport section moves a plurality of pallets along the plurality of transport paths alternating between different transport paths of the plurality of transport paths.

8. The recording apparatus according to claim 1, wherein the second transport section includes the plurality of transport paths, each with a carriage that selectively receives the pallet and reciprocates along the transport path.

* * * * *